United States Patent [19]

Fugate

[11] 4,360,423

[45] Nov. 23, 1982

[54] METHOD AND APPARATUS FOR SEPARATING MATERIALS OF LIGHTER AND HEAVIER SPECIFIC GRAVITIES AND CLEANING THE MATERIAL OF LIGHTER SPECIFIC GRAVITY

[75] Inventor: Kidd S. Fugate, Hazard, Ky.

[73] Assignee: River Processing, Inc., Hazard, Ky.

[21] Appl. No.: 252,054

[22] Filed: Apr. 8, 1981

[51] Int. Cl.[3] ..... B03B 5/36

[52] U.S. Cl. ..... 209/17; 209/172.5; 209/318; 34/33; 34/164

[58] Field of Search ..... 209/17, 172.5, 318, 209/312, 173, 262, 22, 23, 238, 321, 380; 34/33, 38, 164

[56] References Cited

U.S. PATENT DOCUMENTS

| | | | |
|---|---|---|---|
| 2,129,214 | 9/1938 | Hopkins | 34/33 X |
| 2,139,047 | 12/1938 | Tromp | 209/172.5 |
| 2,157,268 | 5/1939 | Ogg | 34/164 |
| 2,521,152 | 9/1950 | Davis | 209/172.5 |
| 2,690,261 | 9/1954 | Maust | 209/172.5 |
| 3,456,785 | 7/1969 | Roller | 209/172.5 X |
| 3,662,886 | 5/1972 | Kennedy | 209/250 |

FOREIGN PATENT DOCUMENTS

| | | | |
|---|---|---|---|
| 9001 | 9/1956 | Fed. Rep. of Germany | 209/17 |

*Primary Examiner*—Ralph J. Hill

*Attorney, Agent, or Firm*—Frank C. Leach, Jr.

[57] ABSTRACT

Raw coal, which contains coal and waste, is introduced into a sizing box having vertically spaced screens inclined rearwardly with the screens being vibrated to separate particles below a selected size from the raw coal. Raw coal is introduced into a washer box, which has a medium therein of a selected specific gravity to cause coal below a specific gravity to float to the top of the medium so as to be separated from the waste with the waste, which is of heavier specific gravity, falling to the bottom of the washer box. The medium and the separated coal therein flow along an inclined trough to a vibrating shaker, which has a plurality of vertically spaced screens inclined rearwardly. When flowing along the trough, at least half of the medium returns to a sump from which it is supplied by a pump to the washer box to maintain a desired level of the medium so that the medium will continuously flow from the washer box along the trough to the shaker. Compressed air is supplied above each of the screens in both the sizing box and the shaker with the compressed air in the sizing box helping to separate the particles from the raw coal. In the shaker, the compressed air removes some of the medium from the particles of coal. Pressurized water also is supplied to the shaker to aid in removing the remaining medium from the coal particles, which are discharged to a conveyor.

31 Claims, 19 Drawing Figures

| FIG. 1A | FIG. 1B |
|---|---|

| FIG. 2A | FIG. 2B |
|---|---|

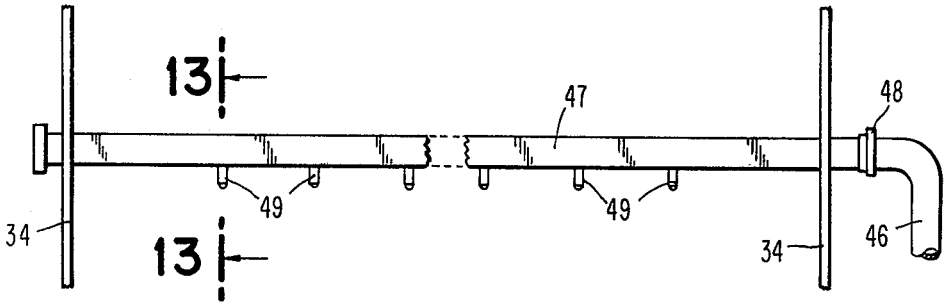
FIG.12
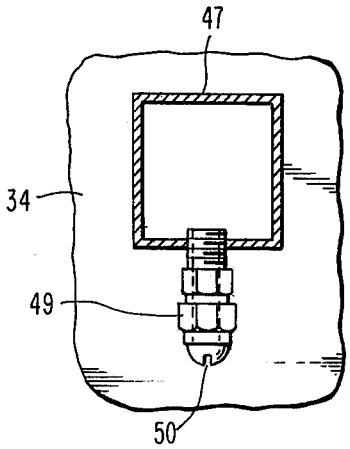
FIG.13
FIG.15
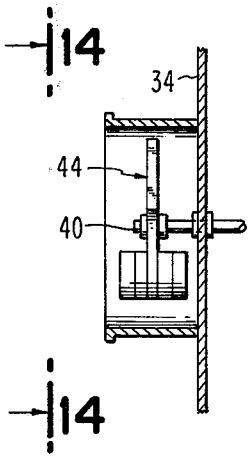
FIG.14
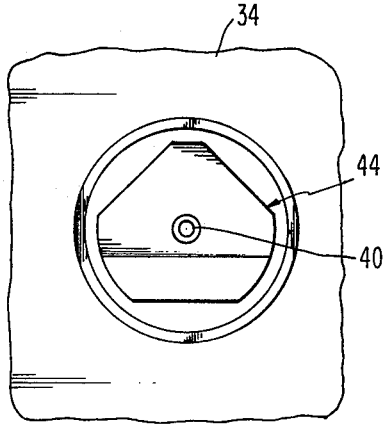

METHOD AND APPARATUS FOR SEPARATING MATERIALS OF LIGHTER AND HEAVIER SPECIFIC GRAVITIES AND CLEANING THE MATERIAL OF LIGHTER SPECIFIC GRAVITY

This invention relates to a method and apparatus for separating materials of different specific gravities from each other and cleaning the material of lighter specific gravity.

Prior to selling coal, it must be separated from the mined raw coal, which contains coal and waste. It also is necessary that the separated coal be relatively clean to insure that it has a desired BTU heating value.

One means of separating and cleaning the coal has been to build a relatively large coal washing structure. This structure requires a relatively large expenditure and a relatively large quantity of water. As an area becomes depleted of raw coal, it is necessary to abandon the coal washing structure or the haul coal for a relatively long distance to the coal washing structure. In either event, the expenses for separating and cleaning coal are increased. However, this relatively large coal washing structure is capable of separating the coal particles into very fine particles and cleaning such fine particles by washing. Thus, the coal, which is separated from the raw coal and cleaned by such a coal washing structure, is capable of meeting specific requirements for BTU heating value, for example.

Various smaller apparatuses for separating the coal from the raw coal and cleaning the separated coal are shown and described in U.S. Pat. No. 2,692,049 to Davis, 2,733,811 to Murry, 2,821,303 to Davis, 2,877,896 to Jones, 3,093,577 to Wilmot, 3,246,749 to Moser, 3,249,226 to Watson, and 3,420,371 to Roller. Thus, various structures have previously been suggested to separate coal from the raw coal and to clean this separated coal.

With recent rules and regulations concerning the environment, the amount of waste water that may be dumped on the ground from an apparatus for separating and cleaning coal is limited without obtaining various permits, which may not be granted. The apparatus of the present invention discharges a relatively small quantity of waste water on the ground. It is sufficiently small that no permit is required to discharge the waste water on the ground.

The apparatus of the present invention discharges approximately twenty gallons per minute of waste water on the ground. This quantity of waste water is easily absorbed in the ground, and no permit is requied. This quantity of waste water is all that is discharged while handling 175–300 tons of raw coal per hour. In the aforesaid Davis U.S. Pat. No., 2,821,303, there is a discharge of forty gallons per minute but there is no indication of the quantity of coal handled. Thus, the apparatus of the present invention discharges only one-half of the quantity of waste water discharged by the aforesaid Davis U.S. Pat. No. 2,821,303.

Because of the relatively small quantity of waste water that is discharged, a large supply of water is not required by the apparatus of the present invention. Therefore, the water, which is used in the apparatus of the present invention, can be obtained from any suitable source such as a creek, for example, without depleting the level of the creek to any extent.

In the apparatus of the present invention, the various elements are disposed in a relatively compact arrangement on a single platform base. This arrangement enables transporting of the apparatus of the present invention from one location to another without necessarily having to disassemble the various elements from each other. Accordingly, it is not necessary to transport mined raw coal a substantially long distance when using the apparatus of the present invention because the apparatus of the present invention can be moved at a more economical cost from one location to another.

An object of this invention is to provide a relatively compact apparatus for separating materials of different specific gravities and cleaning the material of lower specific gravity.

Another object of this invention is to provide a relatively small coal washer structure for separating the coal and the waste and cleaning the separated coal.

A further object of this invention is to provide an apparatus for washing coal in which relatively small quantities of waste water are discharged.

Still another object of this invention is to provide an apparatus for washing coal that requires only a relatively small quantity of water.

A still further object of this invention is to provide a method for separating materials of different specific gravities and cleaning the material of lower specific gravity.

Yet another object of this invention is to provide a method for washing coal in which relatively small quantities of waste water are discharged.

A yet further object of this invention is to provide a method for washing coal in which only a relatively small quantity of water is required.

Other objects of this invention will be readily perceived from the following description, claims, and drawings.

This invention relates to an apparatus for separating and cleaning a material of lighter specific gravity from a material of heavier specific gravity. The apparatus includes first receiving means to receive materials of a lighter specific gravity and heavier specific gravity and first vibrating means to vibrate the first receiving means to separate particles below a selected size from the materials. The remaining materials are received from the first receiving means in fluid containing means having a medium therein of a selected specific gravity to cause the material of lighter specific gravity to float to the top of the medium while the material of heavier specific gravity falls to the bottom of the medium. The medium is supplied to the fluid containing means from a reservoir by supply means to maintain the level of the medium in the fluid containing means at a selected level. Second receiving means receives the material of lighter specific gravity and medium from the upper portion of the fluid containing means with first removal means removing a portion o the medium moving through the second receiving means with the material for return to the reservoir. Third receiving means, which receives the material from a second receiving means, is vibrated by second vibrating means to separate the particles of material in the third receiving means from each other. Compressed air applying means applies compressed air to spaced longitudinal portions of the third receiving means to remove medium from the particles of material in the third receiving means for return to the reservoir. Water applying means applies a spray of water to spaced longitudinal portions of the third receiving means for application to the particles of material in the third receiving means to remove medium therefrom after the compressed air has been applied to at least the first of the spaced longitudinal portions of the third receiving means by the compressed air supplying means.

This invention also relates to a method for separating and cleaning a material of lighter specific gravity from a material of heavier specific gravity including receiving materials of lighter specific gravity and heavier specific gravity and separating particles below a selected size from the materials by vibrating the received materials. The remaining materials are directed to a bath of a medium having a selected specific gravity to cause the material of lighter specific gravity to float to the top of the medium while the material of heavier specific gravity falls to the bottom of the medium. The materials of lighter specific gravity floating on top of the medium is directed to receiving means with some of the medium being collected during travel of the medium and the material of lighter specific gravity to the receiving means from the bath of the medium. The receiving means is vibrated to vibrate the particles of material therein to separate the particles of material from each other with compressed air being applied at spaced longitudinal portions of the receiving means to the vibrating particles of material in the receiving means to remove medium therefrom. A spray of water is applied at spaced longitudinal portions of the receiving means to the vibrating particles of material in the receiving means to remove medium therefrom after the compressed air has been initially applied thereto.

The attached drawings illustrate a preferred embodiment of the invention, in which:

FIG. 14 is a fragmentary sectional view, partly in plan and partly schematic, of a portion of the apparatus of FIG. 3;

Figures 1, 1A:
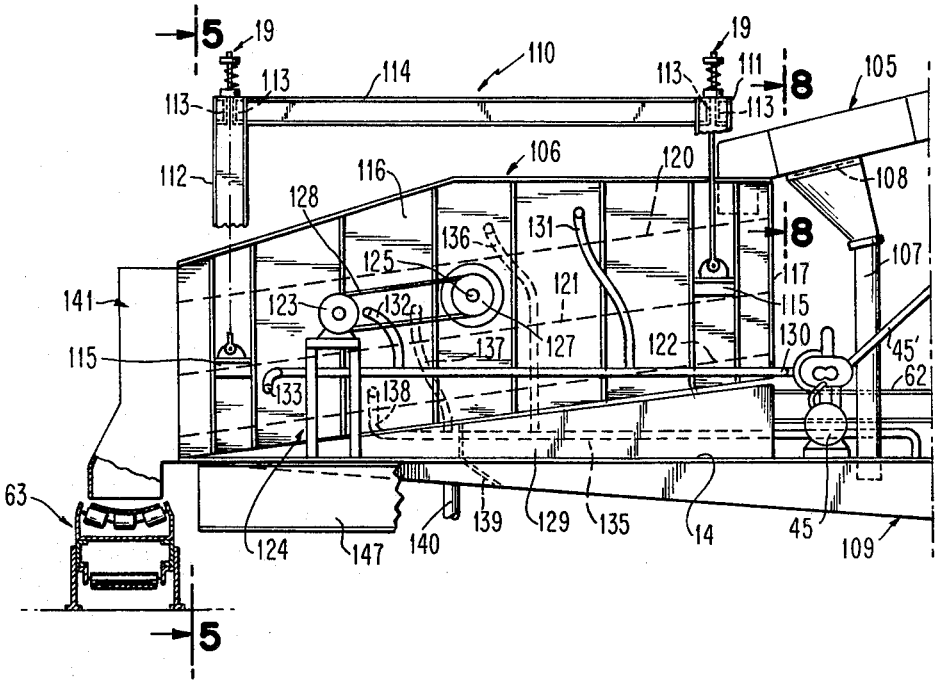
FIG. 1 is a block diagram showing the arrangement of FIGS. 1A and 1B.
FIGS. 1A and 1B are side elevational views, partly schematic, of the separating and cleaning apparatus of the present invention with some parts omitted for clarity purposes.
Figure 1B:
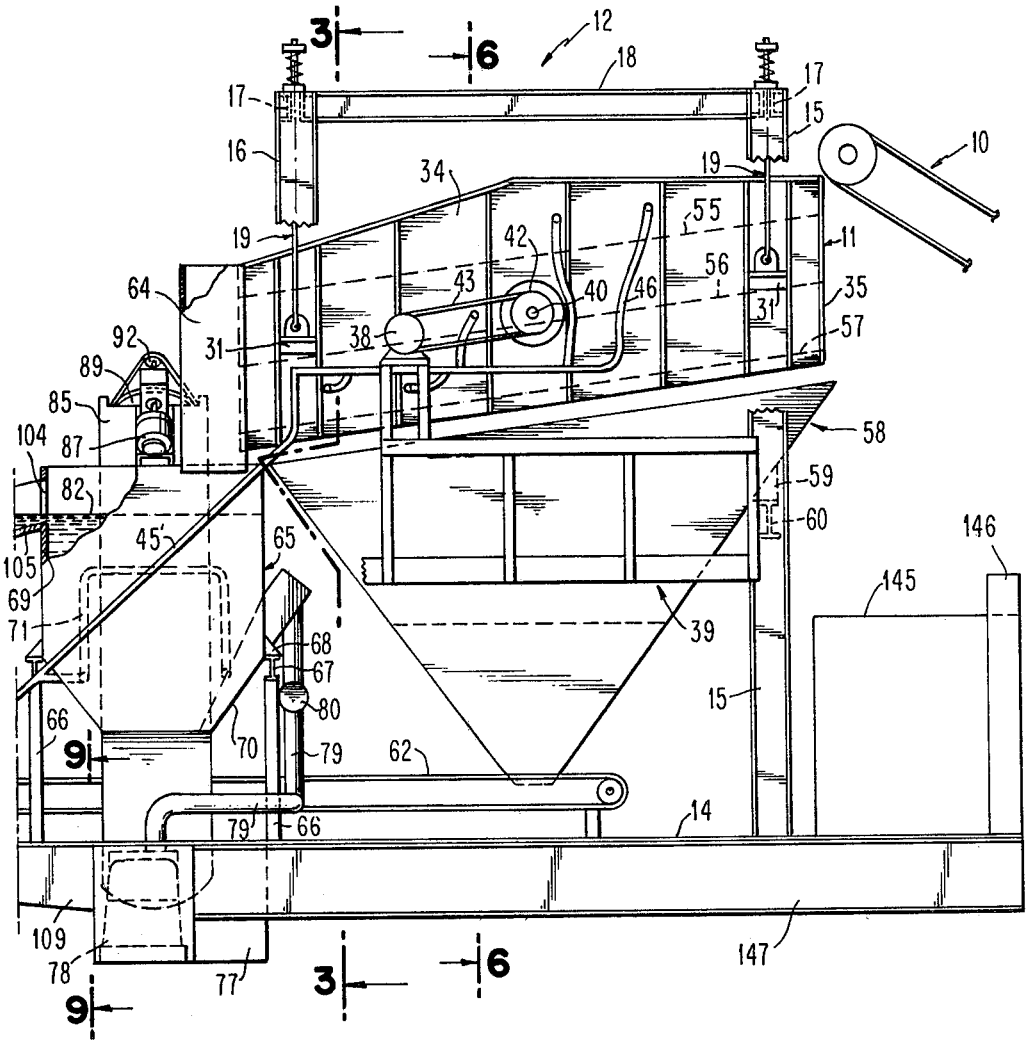
Figure 4:
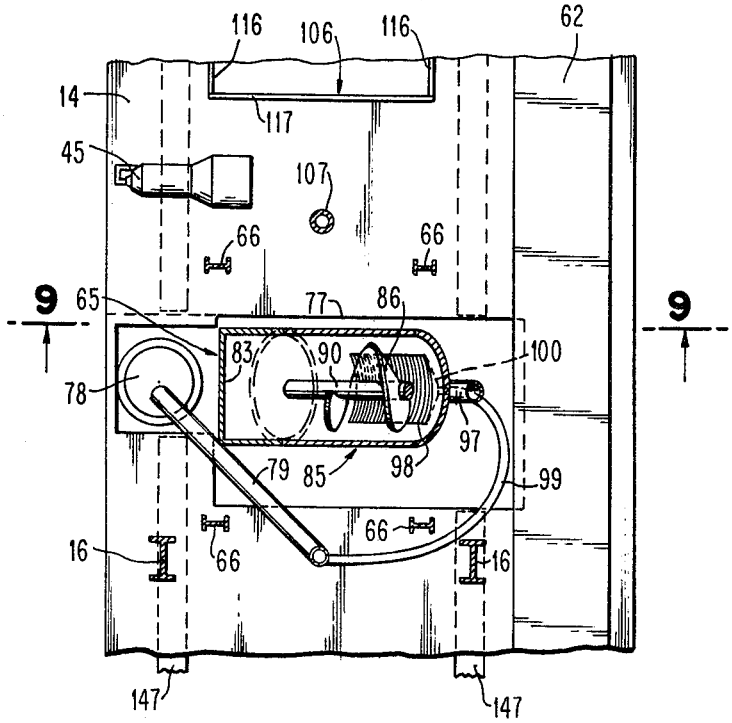
Figure 6:
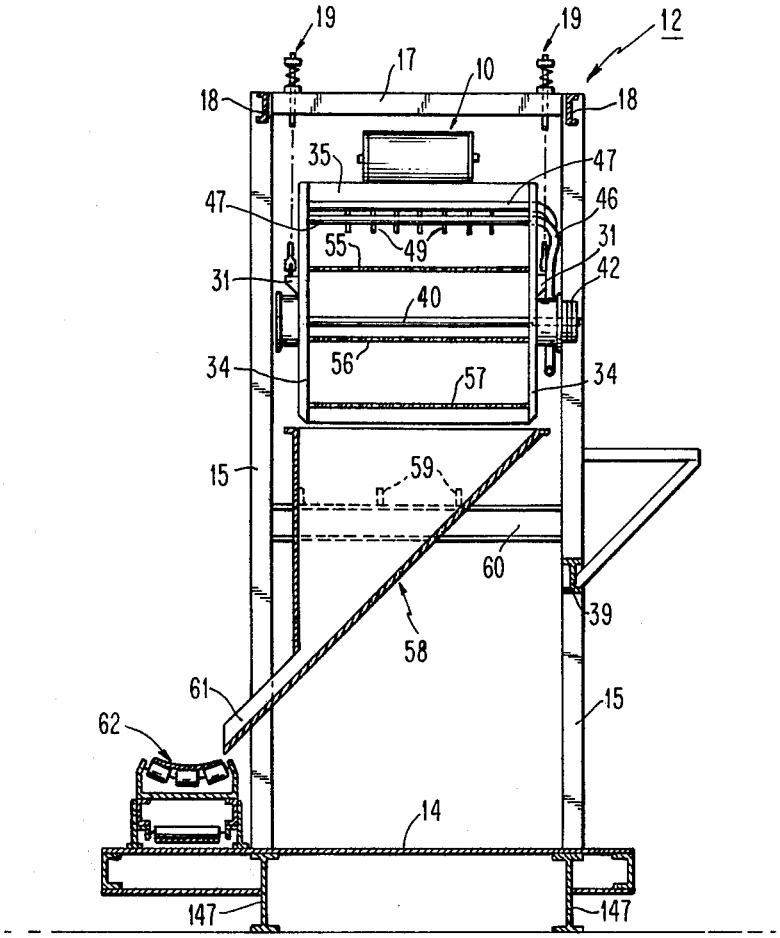
Figure 7:
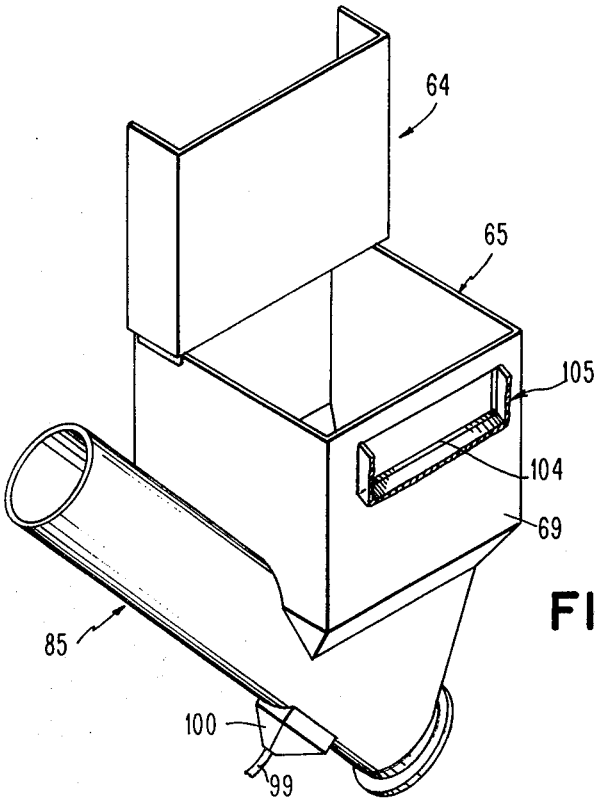
Figure 8:
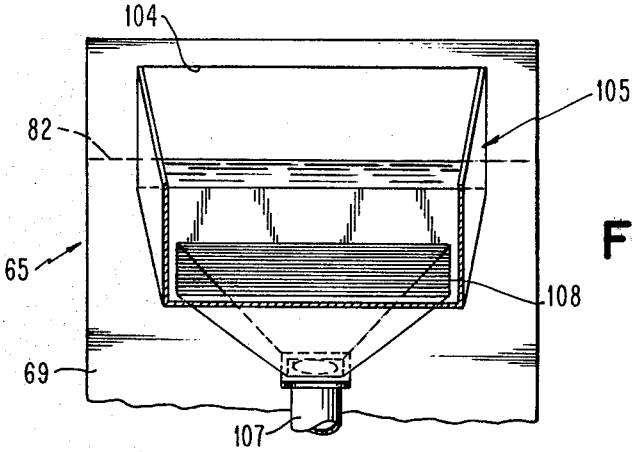
Figure 9:
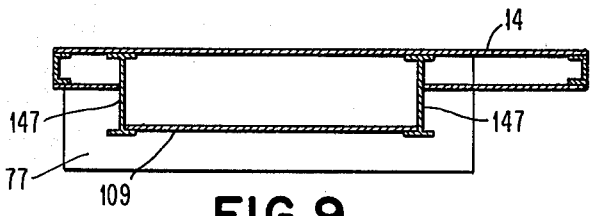
Figure 11:
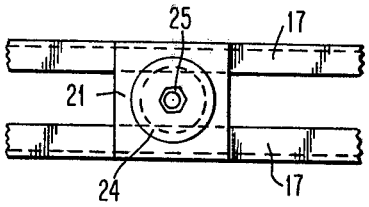
Figure 10:
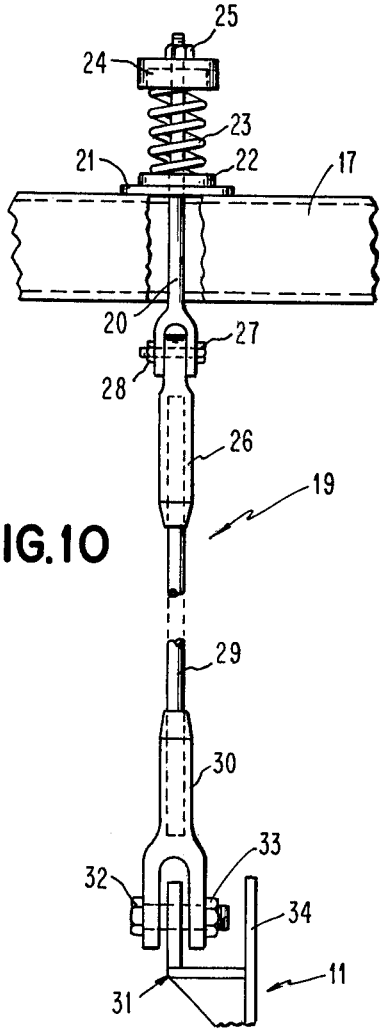

FIG. 6 is a sectional view, partly in elevation and partly schematic, of the apparatus of the present invention and taken along line 6—6 of FIG. 1B; ;p FIG. 7 is a perspective view of a portion of the apparatus of the present invention and showing the relationship of a washer box and an auger housing through which waste is removed from the washer box but with the auger and its driving structure omitted;

FIG. 8 is an elevational view, partly in section, of a trough in which the coal and the medium float from the washer box and taken along line 8—8 of FIG. 1A;

FIG. 9 is a sectional view of a portion of a sump for the medium and its relationship to a hopper returning the medium to the sump and taken along line 9—9 of FIGS. 1B and 4;

FIG. 10 is a fragmentary elevational view of a resilient support structure for resiliently mounting a sizing box of the apparatus of the present invention;

FIG. 11 is a fragmentary top plan view of the resilient support structure of FIG. 10;

FIG. 12 is a fragmentary elevational view, partly in section, showing the arrangement for supplying compressed air to the sizing box and the shaker of the apparatus of the present invention;

FIG. 13 is an enlarged sectional view of the arrangement of FIG. 12 and taken along line 13—13 of FIG. 12;

FIG. 14 is a fragmentary side elevational view of a counter weight arrangement used for causing vibrations of each of the sizing box and the shaker and taken along line 14—14 of FIG. 15; and FIG. 15 is an enlarged fragmentary sectional view of a portion of FIG. 6.

Figures 2, 2A:
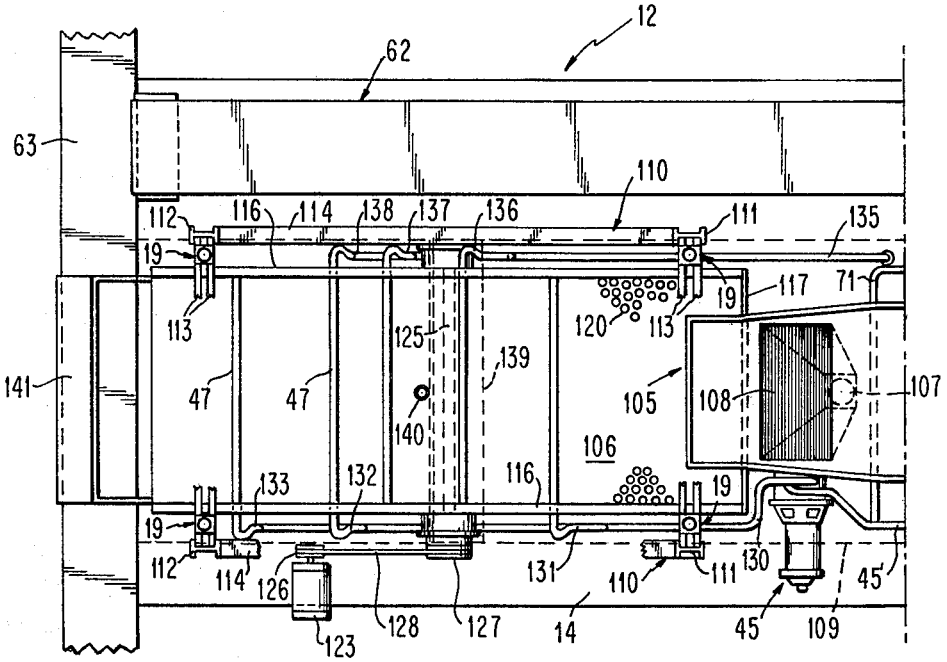
FIG. 2 is a block diagram showing the arrangement of FIGS. 2A and 2B.
FIGS. 2A and 2B are top plan views, partly schematic, of the apparatus of FIGS. 1A and 1B with some parts omitted from clarity purposes.
Figure 2B:
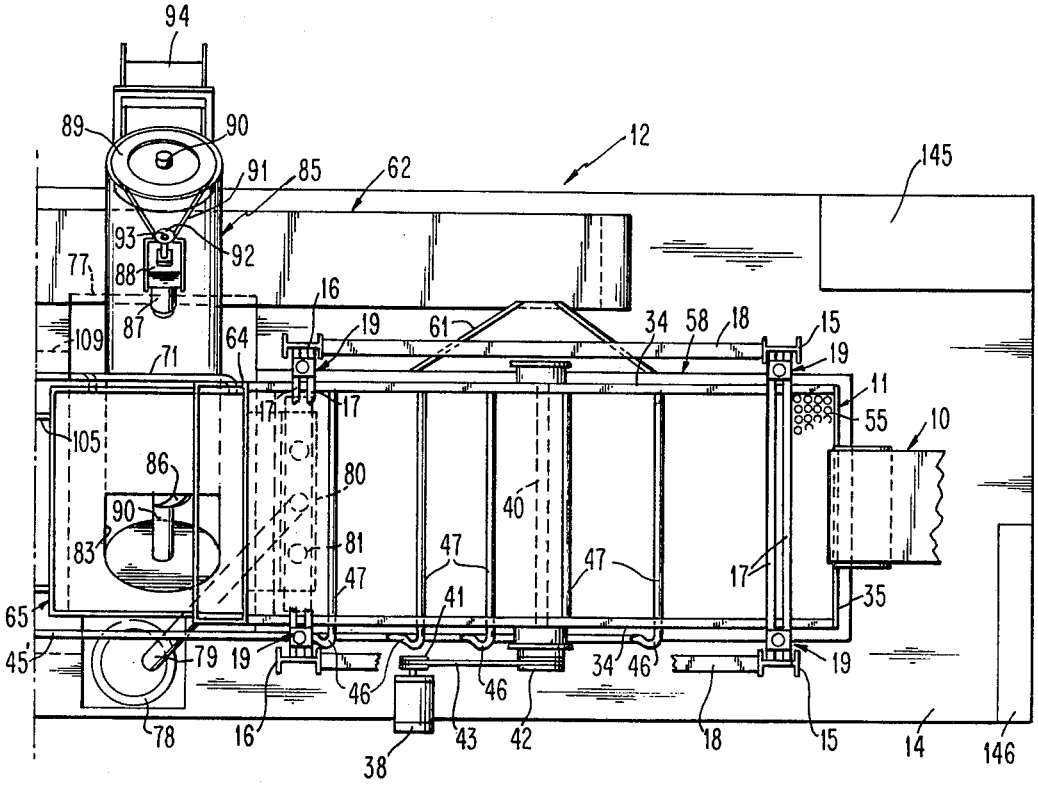

Referring to the drawings and particularly FIGS. 1B and 2B, there is shown a conveyor 10 for supplying raw coal to a sizing box 11 of a coal washer 12. The raw coal includes both coal and ash or waste, which is dirt and non-coal portions of the mined raw coal. The raw coal has been broken up into fragments prior to being supplied to the conveyor 10.

The coal washer 12 includes a base 14, which is preferably a ¼" thick checkered plate floor, having a pair of front support posts 15 and a pair of rear support posts 16 extending upwardly therefrom and supported thereby. As shown in FIG. 2B, each of the support posts 15 and 16 is an I-beam. The front support posts 15 are disposed on opposite sides of the sizing box 11, and the rear support posts 16 are disposed on opposite sides of the sizing box 11.

A first pair of transverse beams 17, which are channel shaped as shown in FIG. 10, extends between the two front support posts 15 as shown in FIG. 2B. A second pair of transverse beams 17 extends between the two rear support posts 16.

Figure 3:
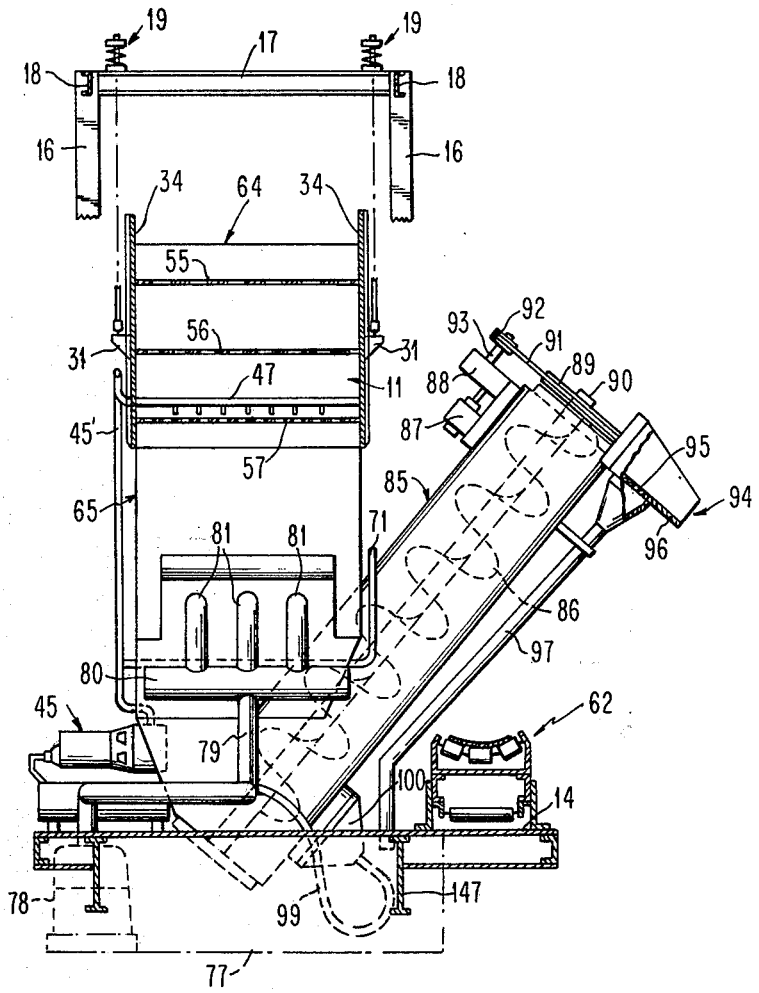
FIG. 3 is a sectional view, partly in elevation and partly schematic, of the apparatus of FIGS. 1A and 1B and taken along line 3—3 of FIG. 1B.

A first longitudinal beam 18 extends between the front support post 15 and the rear support post 16 on one side of the sizing box 11, and a second longitudinal beam 18 extends between the front support post 15 and the rear support post 16 on the other side of the sizing box 11. As shown in FIGS. 3 and 6, each of the beams 18 is channel shaped. Thus, the support posts 15 (see FIGS. 1B and 2B) and 16 and the beams 17 and 18 form a support frame for the sizing box 11.

The sizing box 11 is supported in resilient suspended relation to the beam 17 through four resilient support structures 19. One of the resilient support structures 19 is attached to opposite ends of each pair of the transverse beams 17.

As shown in FIG. 10, each of the resilient support structures 19 includes an upper clevis 20 extending through an opening in a plate 21, which is secured to the top of the pair of transverse beams 17 by suitable means such as welding, for example, between which the upper clevis 20 extends. The plate 21 has a collar 22 fixed to its upper surface with one end of a spring 23 resting therein. The other end of the spring 23 has a collar 24 disposed thereabove and through which the upper clevis 20 extends. The upper clevis 20 has its upper end threaded to receive a nut 25 for attaching the upper clevis 20 to the collar 24, which has the upper end of the spring 23 bearing thereagainst.

The lower end of the upper clevis 20 is pivotally connected to a connector 26 by a bolt 27 and a nut 28 for pivoting about a substantially horizontal axis. The connector 26 has the upper end of a wire rope 29 mechanically anchored thereto.

The lower end of the wire rope 29 is mechanically anchored to a lower clevis 30. The lower clevis 30 is pivotally connected to a bracket 31 by a bolt 32 and a nut 33 for pivoting about a substantially horizontal axis.

The bracket 31 is secured to one of a pair of substantially parallel side plates 34 of the sizing box 11 by suitable means such as welding, for example. The substantially parallel side plates 34 are joined at their front ends by a plate 35 (see FIG. 2B), which is fixed to each of the side plates 34 by suitable means such as welding, for example, so that the front end of the sizing box 11 is closed while its rear or discharge end is open.

As shown in FIG. 2B, the sizing box 11 has four of the resilient support structures 19 to resiliently suspend the rectangular shaped sizing box 11. This enables vibration of the sizing box 11 so that fine coal particles can be separated from the raw coal.

Figure 5:
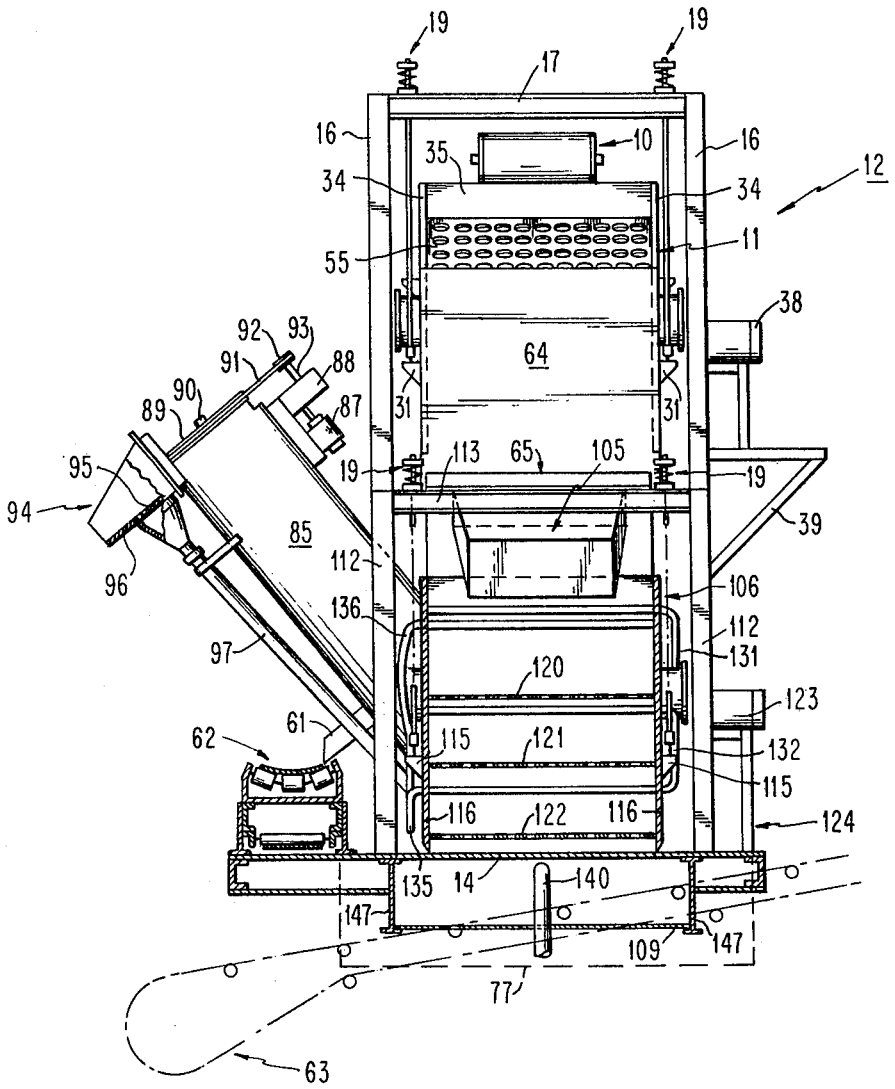
FIG. 5 is an elevational view, partly in section and partly schematic, of the apparatus of the present invention and taken along line 5—5 of FIG. 1A.

The sizing box 11 is vibrated by a motor 38, which is supported by a frame 39 (see FIGS. 1B and 5). The frame 39 is supported by one of the front support posts 15 and one of the rear support posts 16.

The motor 38 (see FIGS. 1B and 2B) rotates a shaft 40, which is journaled in the side plates 34 of the sizing box 11. The motor 38 has a pulley 41 (see FIG. 2B) mounted on its shaft and connected to a pulley 42 on the shaft 40 by a belt 43.

Each end of the shaft 40 has an eccentric weight 44 (see FIGS. 14 and 15) mounted thereon. Thus, as the shaft 40 is rotated by the motor 38 (see FIG. 2B), the sizing box 11 is continuously vibrated because of the eccentric weights 44 (see FIGS. 14 and 15) and the resilient support structures 19 (see FIG. 10).

An air compressor 45 (see FIGS. 1A and 2A), which is supported on the base 14, supplies compressed air through steel pipes 45' and flexible hoses 46 (see FIGS. 1B and 2B) to the interior o the sizing box 11. One suitable example of the air compressor 45 (see FIGS. 1A and 2A) is an air compressor sold as model SP 250 by Gardner-Denver, Dallas, Texas and supplying 250 cubic feet per minute.

As shown in FIG. 12, each of the hoses 46, which supply compressed air to the interior of the sizing box 11, is attached to a square shaped manifold 47, which is supported by the side plates 34 of the sizing box 11, having a round end for the hose 46 by a hose clamp 48. The manifold 47 has a plurality of nozzles 49 mounted therein with each of the nozzles 49 having an opening 50 (see FIG. 13) in its bottom end to produce a spray of air. If the side plates 34 (see FIG. 12) of the sizing box 11 are spaced six feet from each other, each of the outermost nozzles 49 would be disposed one foot from the adjacent side plate 34 with the interior nozzles 49 spaced eight inches from each other and from the outermost nozzles 49. One suitable example of the nozzles 49 is a $\frac{3}{8}$ inch nozzle sold by E. I. Pfaff Company, Cleveland, Ohio as model $\frac{3}{8}$ TR.

The sizing box 11 has a purality of inclined screens 55 (see FIG. 1B), 56, and 57, which are substantially parallel to each other, mounted therein between the side plates 34 and secured thereto by suitable means such as welding, for example. The upper screen 55 has the largest openings while the bottom screen 57 has the smallest openings so that only fine particles of coal will pass through the bottom screen 57 and fall into a hopper 58, which is supported by the support posts 15 and 16 of the coal washer 12.

As an example, the openings in the upper screen 55 have a diameter of $1\frac{1}{4}''$, the openings in the middle screen 56 have a diameter of $\frac{1}{2}''$, and the openings in the bottom screen 57 have a diameter of $\frac{3}{8}''$. Thus, any particles smaller than $\frac{3}{8}''$ will pass through the screen 57 into the hopper 58.

The hopper 58 is attached to each of the support posts 15 and 16 through having a plurality of triangular shaped plates 59 secured to each of its inclined front and rear surfaces by suitable means such as welding, for example. Each of the plates 59 is secured by suitable means such as welding, for example, to an I-beam 60. One of the I-beams 60 extends between the two front support posts 15, and the other of the I-beams 60 extends between the two rear support posts 16. The I-beams 60 are secured to the support posts 15 and 16 by suitable means such as welding, for example.

The hopper 58 has its lower end communicating through a U-shaped trough 61 (see FIGS. 2B and 6) with a conveyor 62. Thus, the conveyor 62 conveys the fine particles of coal smaller than the openings in the bottom screen 57 (see FIG. 1B) from the trough 61 (see FIGS. 2B and 6) to a conveyor 63 (see FIG. 2A), which is disposed at the discharge or rear end of the coal washer 12 as shown in FIGS. 1A and 2A.

The compressed air is supplied from the compressor 45 by the pipes 45' and the hoses 46 (see FIG. 1B) to the sizing box 11 above each of the screens 55, 56, and 57. The purpose of the compressed air is to aid in separating the particles of raw coal within the sizing box 11 from each other.

The raw coal moves along the inclined screens 55, 56, and 57 on the sizing box 11 to a discharge chute 64, which is disposed at the rear end of the sizing box 11. The lower end of the discharge chute 64 communicates with the upper end of a washer box 65 at one side thereof and is secured to the washer box 65 by suitable means such as welding, for example. The washer box 65 is supported from the base 14 of the coal washer 12 by vertical support posts 66.

The support posts 66, which are I-beams having their lower ends secured by suitable means such as welding, for example, to the base 14, have horizontal I-beams 67 extending between their upper ends. Each of the I-beams 67 is attached by suitable means such as welding, for example, to the upper end of the two support posts 66 between which it extends. There are four of the support posts 66 and four of the I-beams 67.

The upper surface of each of the four I-beams 67 has a gusset plate 68 secured thereto by suitable means such as welding, for example. The gusset plates 68 are disposed adjacent the lower ends of substantially vertical side walls 69 of the washer box 65. The washer box 65 has an inclined side wall 70 extending downwardly from the lower end of each of the vertical side walls 69 beneath its attachment to the gusset plate 68.

It should be understood that there are four of the gusset plates 68 extending around the four vertical side walls 69 of the washer box 65. Thus, the washer box 65 is supported by the base 14.

The washer box 65 has a medium, which is a liquid having a selected specific gravity, therein. One suitable example of the medium is a mixture of magnetite and water.

The medium has its specific gravity selected to be greater than the specific gravity of the coal, which is to be separated from the ash or waste, and less than the specific gravity of the ash or waste. This enables the coal to float to the top of the medium in the washer box 65 while the ash falls to the bottom of the medium in the washer box 65. The specific gravity of the medium is in the range of 1.35 to 1.55 when the specific gravity of the coal to be separated and cleaned is 1.30 and the specific gravity of the ash or waste is greater than 1.60.

Compressed air is supplied to the washer box 65 through hoses 71 connected to the pipes 45'. The compressed air creates a turbulence in the medium in the washer box 65 to prevent the coal and the ash or waste from falling too fast through the medium after entering the washer box 65 through the discharge chute 64. The compressed air also aids in separating relatively large pieces from each other.

The medium is supplied to the washer box 65 from a sump or reservoir 77, which is supported beneath the base 14 of the coal washer 12. Th medium is pumped from the sump 77 by a pump 78 through pipes 79 to a substantially horizontal manifold 80. The manifold 80 communicates through three separate pipes 81 (see FIG. 3) to the interior of the washer box 65.

The pump 78 has its size selected so that it maintains the medium within the washer box 65 at a selected level as indicated at 82 in FIG. 1B. One suitable example of the pump 78 is an eight inch pump sold as model 5000 by Goyne Pump Company, Ashland, Pennsylvania.

The total quantity of the medium being circulated constantly by the pump 78 is about twenty-one hundred gallons. It is necessary to add magnetite periodically to maintain the desired specific gravity of the medium in addition to adding water for the loss of some of the medium.

The ash or waste, which falls to the bottom of the washer box 65, escapes therefrom by gravity through an opening 83 (see FIG. 4) in the bottom of the washer box 65 into the bottom of an inclined cylindrical housing 85 (see FIGS. 2B, 3–5, and 7). The housing 85 has an auger or flight conveyor 86 (see FIGS. 3 and 4) mounted therein for conveying the ash or waste up the housing 85. The ash or waste falls from the upper end of the housing 85 by gravity.

The auger 86 is driven from a motor 87, which is mounted on the exterior of the housing 85 as shown in FIG. 3, through a gear reducing box 88 to rotate a pulley 89 on the end of a shaft 90 of the auger 86. The pulley 89 is connected by a belt 91 to a pulley 92 on an output shaft 93 of the gear reducing box 88.

The ash or waste, which exits from the upper end of the housing 85 by rotation of the auger 86, falls therefrom by gravity into a U-shaped trough 94. The trough 94 is supported on the housing 85 and directs the ash or waste at substantially 90° to the axis of the shaft 90 of the auger 86. The U-shaped trough 94 has a screened opening 95 in an upper portion of its bottom 96 to allow the medium, which does not flow back down along the inner surface of the housing 85 between the outer circumference of the auger 86 and the inner surface of the housing 85 because of the auger 86 being spaced from the housing 85, to pass through the screened opening 95 into a pipe 97 for return to the sump 77.

The lower end of the auger housing 85 has the medium supplied thereto through a screen 98 (see FIG. 4). The screen 98 is preferably a one millimeter slotted Wedgewire screen, which is a screen formed by bars spaced one millimeter from each other to form the one millimeter slots.

In addition to the medium flowing from the washer box 65 through the opening 83 with the ash or waste to the housing 85, the medium is supplied to the housing 85 from the sump 77 by the pump 78 through the pipe 79 to a flexible hose 99 through which it flows into a box 100 (see FIG. 3), which is fixed to the housing 85. The medium is supplied from the box 100 through the screen 98 (see FIG. 4) to the lower end of the housing 85 (see FIG. 3) after the ash or waste has entered the housing 85 from the washer box 65 to agitate the ash or waste within the housing 85 to enable it to be moved more easily up the housing 85 by the auger 86 since the auger 86 does not extend to the bottom of the housing 85.

The coal, which floats to the top of the medium within the washer box 65, flows by gravity with the medium from the washer box 65 through an opening 104 (see FIG. 7) in one of the vertical walls 69 of the washer box 65 into the upper end of an inclined trough 105 (see FIGS. 1A, 2A, and 8). The U-shaped trough 105 directs the coal and the medium to a shaker 106 (see FIGS. 1A and 2A) communicating with the lower end of the trough 105. As the coal and medium flow along the inclined trough 105, some of the medium enters a drain 107 through a screen 108, which is a one millimeter Wedgewire screen, to return the medium to the sump 77 by a trough 109, which is supported by the base 14 and beneath the base 14.

The shaker 106 is resiliently supported from a frame 110, which is supported on the base 14 of the coal washer 12, by four of the resilient support structures 19. The frame 110 includes a pair of front support posts 111 on opposite sides of the shaker 106 as shown in FIG. 2A, a pair of rear support posts 112 on opposite sides of the shaker 106, a first pair of transverse channel shaped beams 113 extending between the forward support posts 111, a second pair of transverse channel shaped beams 113 extending between the rear support posts 112, a first longitudinal beam 114 extending between the front support post 111 and the rear support post 112 on one side of the shaker 106, and a second longitudinal beam 114 extending between the front support post 111 and the rear support post 112 on the other side of the shaker 106.

Each of the support posts 111 and 112 is an I-beam. Each of the longitudinal beams 114 is a channel beam having the same shape as each of the longitudinal beams 18 (see FIG. 2B).

Each of the resilient support structures 19 (see FIG. 2A) is resiliently attached to a pair of the channel shaped beams 113 adjacent each of the four support posts 111 and 112 in the same manner as each of the resilient support structures 19 is connected to the channel shaped beams 17. This is shown in FIG. 10.

Each of the resilient support structures 19 has its lower end pivotally connected to a bracket 115 (see FIGS. 1A and 5), which is the same as the bracket 31 (see FIG. 10), secured at each of two longitudinally spaced portions on each of a pair of substantially parallel side plates 116 (see FIGS. 1A and 2A) of the shaker 106 by suitable means such as welding, for example. The shaker 106 includes a front plate 117, which is secured to the forward end of each of the two substantially parallel side plates 116 by suitable means such as welding, for example.

The shaker 106 has a plurality of inclined screens 120, 121, and 122, which are substantially parallel to each other, extending between the side plates 116 and fixed to the side plates 116 by suitable means such as welding, for example. Each of the screens 120, 121, and 122 has the openings therein decreasing in size from the top screen 120 to the bottom screen 122 so that the smallest openings are in the screen 122.

A motor 123, which is supported on a frame 124 mounted on the base 14 of the coal washer 12, rotates a shaft 125, which is journaled in the side plates 116 of the shaker 106. The motor 123 has a pulley 126 mounted on its shaft and connected to a pulley 127 on the shaft 125 by a belt 128.

Each end of the shaft 125 has an eccentric weight like the eccentric weight 44 (see FIGS. 14 and 15) mounted thereon. Accordingly, as the shaft 125 (see FIG. 1A) is rotated, the shaker 106 is vibrated.

As the shaker 106 is vibrated, the particles of coal on the upper screen 120 move along the inclined screen 120 towards its discharge end. At the same time, the various particles of smaller size than the mesh of the screen 120 fall therethrough onto the screen 121. Likewise, the particles of coal on the vibrating screen 121 move along the screen 121 toward the discharge end of the shaker 106 while particles smaller than the mesh of the screen 121 fall to the screen 122.

The mesh of the screen 122 is selected so that particles should not fall therethrough but only move therealong to the discharge end of the shaker 106. At the same time, any medium, which is removed from the particles of coal in the shaker 106, falls through the screens 120–122 into a hopper 129, which is supported by the base 14 and communicates with the trough 109.

As an example, the openings in the upper screen 120 have a diameter of $1\frac{1}{4}''$, the openings in the middle screen 121 have a diameter of $\frac{3}{4}''$, and the openings in the bottom screen 122 have a diameter of one millimeter. Thus, the very small size of the openings in the bottom screen 122 substantially prevents particles of coal from passing therethrough.

Compressed air is supplied through a main air pipe 130 from the compressor 45 to the interior of the shaker 106. This compressed air removes as much of the medium from the particles of coal in the shaker 106 as is possible.

The main air pipe 130 is connected through a flexible branch hose 131 to a position above the upper screen 120. A flexible branch hose 132, which is rearward of the branch hose 131, directs air above the middle screen 121 and below the upper screen 120. A flexible branch hose 133 directs compressed air above the bottom screen 122 and below the middle screen 121 and rearwardly of the branch hose 132. It should be understood that each of the branch hoses 131–133 directs the air through the nozzles 49 (see FIG. 13) on the manifold 47 in the same manner as previously described for directing compressed air to the sizing box 11 (see FIG. 1B).

Pressurized water is supplied from a pump (not shown), which would be disposed adjacent the source of water such as a creek, for example, through a main water supply pipe 135 (see FIG. 1A) to longitudinally spaced portions of the shaker 106. The main water supply pipe 135 has a flexible branch hose 136 directing pressurized water above the upper screen 120 and rearwardly of the air branch hose 131. Thus, pressurized water, which is utilized to remove the medium from the particles of coal, is not applied to the particles of coal on the upper screen 120 until after the compressed air has been applied to the particles of coal on the upper screen 120 through the branch hose 131.

The main water pipe 135 has a second flexible branch hose 137 communicating with the shaker 106 above the middle screen 121 and below the upper screen 120. The second branch hose 137 is forward of the air branch hose 132 so that the compressed air acts on the particles of coal on the middle screen 121 after they have been subjected to the pressurized water.

The main water supply pipe 135 has a third flexible branch hose 138 communicating with the interior fo the shaker 106 above the bottom screen 122 and below the middle screen 121. The outlet of the third branch hose 138 is in substantially vertical alignment with the outlet of the air branch hose 132 as shown in FIGS. 1A and 2A. The third branch hose 138 is forward of the air branch hose 133 so that pressurized air is applied to the particles of coal on the bottom screen 122 (see FIG. 1A) after they have finally been subjected to the rinse water during their travel along the bottom screen 122.

The branch water hoses 136–138 supply the pressurized water in a spray through the use of the same type of arrangement as the air is supplied. That is, each of the branch hoses 136–138 is connected to the round end of one of the square shaped manifolds 47 (see FIG. 13), which have the spray nozzles 49 to supply the water under pressure into the interior of the shaker 106 (see FIG. 1A) as a spray.

The hopper 129 collects the medium, which is removed from the particles of coal in the inlet portion of the shaker 106, for return to the sump 77 (see FIG. 1B) through the trough 109 with which the hopper 129 (see FIG. 1A) communicates. A baffle 139 is mounted in the hopper 129 and the trough 109 to direct the medium and the rinse water on its forward side to the sump 77. On the discharge or rear side of the baffle 139, the rinse water and medium flow through a drain pipe 140 to the ground.

The particles of coal fall from the discharge end of each of the inclined screens 120–122 of the shaker 106 into a discharge chute 141, which is supported by the base 14. The discharge chute 141 directs the coal to the conveyor 63.

The base 14 of the coal washer 12 has a motor generator set, schematically shown at 145 (see FIG. 1B), supported thereon. This generates electricity for motors for operating the conveyor 10, the compressor 45 (see FIG. 1A), the conveyor 62, the conveyor 63, the pump 78 (see FIG. 1B), and the pump (not shown) for the supply of the water under pressure through the main water pipe 135 (see FIG. 1A), and the motors 38 (see FIG. 1B) and 123 (see FIG. 1A). One suitable example of the motor generator set 145 (see FIG. 1B) is sold by Caterpillar Tractor Company as model D353.

The base 14 has a motor control center, schematically shown at 146, mounted thereon. The motor control center 146 comprises a motor control starter for each of the electric motors receiving electricity from the motor generator set 145.

The base 14 is supported by I-beams 147, which are secured to the bottom of the base 14 by suitable means such as welding, for example. The I-beams 147 are interrupted by the sump 77.

The I-beams 147 are supported by concrete or wood supports (not shown) resting on the ground. The I-beams 147 function as the side walls of the trough 109 as shown in FIG. 9.

If desired, the base 14 (see FIG. 1B) may be supported by vertical posts in vertically spaced relation to a concrete base, which would support a triangular shaped reservoir, for example, for the medium rather than using the sump or reservoir 77 supported by the base 14. The triangular shaped reservoir insures that the magnetite remains suspended in the water.

While the present invention has shown and described coal as being separated from ash or waste of a higher specific gravity than the coal being cleaned, it should be understood that the present invention may be utilized with any two materials of different specific gravities which it is desired to separate with the material of lighter specific gravity being cleaned.

An advantage of this invention is that it does not require a large supply of water. Another advantage of this invention is that it discharges a relatively small quantity of waste water onto the ground. A further advantage of this invention is that it may be transported from one location to another. Still another advantage of this invention is that it is relatively compact. A still further advantage of this invention is that it has a substantially closed circuit for the separating medium.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A method for separating and cleaning a material of lighter specific gravity from a material of heavier specific gravity including:

receiving materials of lighter specific gravity and heavier specific gravity;

separating particles of the materials from each other by vibrating the received materials;

removing separated particles below a selected size from the received materials;

directing the remaining materials initially to the top of a bath of a medium having a selected specific gravity to cause the material of lighter specific gravity to float to the top of the medium while the material of heavier specific gravity falls to the bottom of the bath of the medium;

supplying medium to the bath from a reservoir;

directing the material of lighter specific gravity floating on top of the bath of the medium to receiving means;

collecting some of the medium during travel of the medium and the material of lighter specific gravity to the receiving means from the bath of the medium;

returning the collected medium to the reservoir;

vibrating the receiving means to vibrate the particles of material therein to separate the particles of material from each other;

applying compressed air at spaced longitudinal portions of the receiving means to the vibrating particles of material in the receiving means to remove medium therefrom;

applying a spray of water at spaced longitudinal portions of the receiving means to the vibrating particles of material to remove medium therefrom in the receiving means after the compressed air has been initially applied thereto;

collecting medium removed from the vibrating particles of material in the receiving means at at least the first spaced longitudinal portion of the receiving means to which the compressed air is applied;

returning the collected medium removed from the vibrating particles of material in the receiving means to the reservoir;

removing from the bottom of the bath of the medium the material of heavier specific gravity that falls to the bottom of the bath of the medium;

and applying compressed air to the bath of the medium above its bottom to create turbulence therein to aid in separating the material of lighter specific gravity from the material of heavier specific gravity.

2. An apparatus for separating and cleaning a material of lighter specific gravity from a material of heavier specific gravity including:

first receiving means to receive materials of lighter specific gravity and heavier specific gravity;

first vibrating means to vibrate said first receiving means to separate particles of the materials from each other;

said first receiving means including sizing means to allow separated particles below a selected size to be removed from the materials;

fluid containing means including a medium therein to receive the remaining materials from said first receiving means initially in the top of the medium, the medium having a selected specific gravity to cause the material of lighter specific gravity to float to the top of the medium while the material of heavier specific gravity falls to the bottom of the medium;

a reservoir for the medium;

means to supply the medium to said fluid containing means from said reservoir to maintain the level of the medium in said fluid containing means at a selected level;

second receiving means to receive the material of lighter specific gravity and medium from the upper portion of said fluid containing means;

first removal means to remove a portion of the medium moving through said second receiving means with the material for return to said reservoir;

third receiving means to receive the material of lighter specific gravity and the remaining medium from said second receiving means;

second vibrating means to vibrate said third receiving means to separate the particles of material in said third receiving means from each other;

compressed air applying means to apply compressed air to spaced longitudinal portions of said third receiving means to remove medium from the particles of material in said third receiving means for return to said reservoir;

water applying means to apply a spray of water to spaced longitudinal portions of said third receiving means for application to the particles of material in said third receiving means to remove medium therefrom after the compressed air has been applied to at least the first of said spaced longitudinal portions of said third receiving means by said compressed air applying means;

first return means to return to said reservoir at least the medium removed from the particles of material in said third receiving means by said compressed air applying means at the first of said spaced longitudinal portions of said third receiving means;

second removal means to remove from the bottom of said fluid containing means the material of heavier specific gravity that sinks to the bottom of the medium in said fluid containing means;

and means to supply medium from said reservoir to said second removal means to agitate the material of heavier specific gravity within said second removal means.

3. An apparatus for separating and cleaning a material of lighter specific gravity from a material of heavier specific gravity including:

first receiving means to receive materials of lighter specific gravity and heavier specific gravity;

first vibrating means to vibrate said first receiving means to separate particles of the materials from each other;

said first receiving means including sizing means to allow separated particles below a selected size to be removed from the materials;

fluid containing means including a medium therein to receive the remaining materials from said first receiving means initially in the top of the medium, the medium having a selected specific gravity to cause the material of lighter specific gravity to float to the top of the medium while the material of heavier specific gravity falls to the bottom of the medium;

a reservoir for the medium;

means to supply the medium to said fluid containing means from said reservoir to maintain the level of the medium in said fluid containing means at a selected level;

second receiving means to receive the material of lighter specific gravity and medium from the upper portion of said fluid containing means;

first removal means to remove a portion of the medium moving through said second receiving means with the material for return to said reservoir;

third receiving means to receive the material of lighter specific gravity and the remaining medium from said second receiving means;

second vibrating means to vibrate said third receiving means to separate the particles of material in said third receiving means from each other;

compressed air applying means to apply compressed air to spaced longitudinal portions of said third receiving means to remove medium from the particles of material in said third receiving means for return to said reservoir; water applying means to apply a spray of water to spaced longitudinal portions of said third receiving means for application to the particles of material in said third receiving means to remove medium therefrom after the compressed air has been applied to at least the first of said spaced longitudinal portions of said third receiving means by said compressed air applying means;

first return means to return to said reservoir at least the medium removed from the particles of material in said third receiving means by said compressed air applying means at the first of said spaced longitudinal portions of said third receiving means;

second removal means to remove from the bottom of said fluid containing means the material of heavier specific gravity that sinks to the bottom of the medium in said fluid containing means;

means to apply compressed air to spaced longitudinal portions of said first receiving means to aid in separating the particles below the selected size from the materials in said first receiving means;

and means to apply compressed air to the medium within said fluid containing means above its bottom to create turbulence within the medium in said fluid containing means.

4. The apparatus according to claim 3 in which: said third receiving means has a plurality of screens spaced vertically from each other, each of said screens is inclined from its front end rearwardly to the discharge end of said third receiving means;

said screens are substantially parallel to each other;

said third receiving means has the uppermost of said screens receive the material of lighter specific gravity and the remaining medium from said second receiving means adjacent its front end;

each of said screens is of smaller mesh in vertically descending order;

and said compressed air applying means includes means introducing compressed air above each of said screens to remove medium from the particles of material, said introducing means introducing compressed air above the uppermost of said screens only forwardly of the introducing of compressed air above any of the other of said screens and introducing compressed air in rearwardly descending order above each of the other of said screens to the lowermost of said screens.

5. The apparatus according to claim 4 in which:

said sizing means of said first receiving means has a plurality of screens spaced vertically from each other, each of said screens is inclined from its front end rearwardly to the discharge end of said first receiving means;

said screens are substantially parallel to each other;

said sizing means of said first receiving means has the uppermost of said screens receive the materials of lighter specific gravity and heavier specific gravity adjacent its front end;

each of said screens is of smaller mesh in vertically descending order;

and said compressed air applying means includes means introducing compressed air above each of said screens, said introducing means introducing compressed air above the uppermost of said screens only forwardly of the introducing of compresed air above any of the other of said screens and introducing compressed air in rearwardly descending order above each of the other of said screens to the lowermost of said screens.

6. The apparatus according to claim 5 in which:

said water applying means applies a spray of water above each of said inclined screens of said third receiving means;

and said water applying means applies a spray of water above the uppermost of said screens rearwardly of said introducing means of said compressed air applying means introducing the compressed air above the uppermost of said screens.

7. The apparatus according to claim 6 including:

medium collecting means to collect the medium from the material of heavier specific gravity in said second removal means for return to said reservoir;

and second return means to return the medium from said medium collecting means to said reservoir.

8. The apparatus according to claim 7 including a platform base supporting said first receiving means, said fluid containing means, said second receiving means, said first removal means, said third receiving means, and said reservoir.

9. The apparatus according to claim 8 including:
first conveying means to receive the cleaned material from said third receiving means;
and second conveying means supported by said platform base to convey the separated particles below a predetermined size from said first receiving means to said first conveying means.

10. The apparatus according to claim 8 in which:
said first return means includes:
hopper means disposed beneath said third receiving means from its front end to a position rearwardly of where said compressed air applying means applies the compressed air to the first of said spaced longitudinal portions of said third receiving means and said water applying means first applies a spray of water to said third receiving means to collect the medium from said third receiving means;
and means to communicate said hopper means with said reservoir to return the medium to said reservoir from said hopper means;
and said hopper means is supported by said platform base.

11. The apparatus according to claim 8 including:
a first group of support posts extending upwardly from said platform base and disposed exterior and adjacent said first receiving means;
means to resiliently mount said first receiving means on said first group of support posts;
a second group of support posts extending upwardly from said platform base and disposed exterior and adjacent said third receiving means;
and means to resiliently mount said third receiving means on said second group of support posts.

12. The apparatus according to claim 7 including:
said fluid containing means having an opening in its bottom through which the material of heavier specific gravity and medium flow;
said second removal means including an inclined housing communicating with said opening in the bottom of said fluid containing means to receive the material of heavier specific gravity and medium from said fluid containing means, said inclined housing having an open upper end;
means within said inclined housing to convey the material of heavier specific gravity upwardly for discharge through the open upper end of said inclined housing;
and said medium collecting means collecting the medium from the material of heavier specific gravity in said inclined housing at the open upper end thereof.

13. The apparatus according to claim 12 including means to introduce medium from said reservoir into said inclined housing adjacent its lower end to agitate the material of heavier specific gravity therein.

14. The apparatus according to claim 4 in which:
said water applying means applies a spray of water above each of said inclined screens of said third receiving means;
and said water applying means applies a spray of water above the uppermost of said screens rearwardly of said introducing means of said compressed air applying means introducing the compressed air above the uppermost of said screens.

15. The apparatus according to claim 4 in which:
said water applying means includes spray means to apply a spray of water above each of said inclined screens of said third receiving means;
said spray means of said water applying means applies a spray of water above the uppermost of said screens rearwardly of said introducing means of said compressed air applying means introducing the compressed air above the uppermost of said screens;
and said spray means of said water applying means applies a spray of water above any of the other of said screens forwardly of said introducing means of said compressed air applying means introducing the compressed air above the same screen.

16. An apparatus for separating and cleaning a material of lighter specific gravity from a material of heavier specific gravity including:
first receiving means to receive materials of lighter specific gravity and heavier specific gravity;
first vibrating means to vibrate said first receiving means to separate particles of the materials from each other;
said first receiving means including sizing means to allow separated particles below a selected size to be removed from the materials;
fluid containing means including a medium therein to receive the remaining materials from said first receiving means initially in the top of the medium, the medium having a selected specific gravity to cause the material of lighter specific gravity to float to the top of the medium while the material of heavier specific gravity falls to the bottom of the medium;
a reservoir for the medium;
means to supply the medium to said fluid containing means from said reservoir to maintain the level of the medium in said fluid containing means at a selected level;
second receiving means to receive the material of lighter specific gravity and medium from the upper portion of said fluid containing means;
first removal means to remove a portion of the medium moving through said second receiving means with the material for return to said reservoir;
third receiving means to receive the material of lighter specific gravity and the remaining medium from said second receiving means;
second vibrating means to vibrate said third receiving means to separate the particles of material in said third receiving means from each other;
compressed air applying means to apply compressed air to spaced longitudinal portions of said third receiving means to remove medium from the particles of material in said third receiving means for return to said reservoir.
water applying means to apply a spray of water to spaced longitudinal portions of said third receiving means for application to the particles of material in said third receiving means to remove medium therefrom after the compressed air has been applied to at least the first of said spaced longitudinal portions of said third receiving means by said compressed air applying means;
first return means to return to said reservoir at least the medium removed from the particles of material in said third receiving means by said compressed air applying means at the first of said spaced longitudinal portions of said third receiving means;

second removal means to remove from the bottom of said fluid containing means the material of heavier specific gravity that sinks to the bottom of the medium in said fluid containing means;

and means to apply compressed air to the medium within said fluid containing means above its bottom to create turbulence within the medium in said fluid containing means.

17. The apparatus according to claim 16 in which:

said third receiving means has a plurality of screens spaced vertically from each other, each of said screens is inclined from its front end rearwardly to the discharge end of said third receiving means;

said screens are substantially parallel to each other;

said third receiving means has the uppermost of said screens receive the material of lighter specific gravity and the remaining medium from said second receiving means adjacent its front end;

each of said screens is of smaller mesh in vertically descending order;

and said compressed air applying means includes means introducing compressed air above each of said screens to remove medium from the particles of material, said introducing means introducing compressed air above the uppermost of said screens only forwardly of the introducing of compressed air above any of the other of said screens and introducing compressed air in rearwardly descending order above each of the other of said screens to the lowermost of said screens.

18. The apparatus according to claim 17 in which:

said sizing means of said first receiving means has a plurality of screens spaced vertically from each other, each of said screens is inclined from its front end rearwardly to the discharge end of said first receiving means;

said screens are substantially parallel to each other;

said sizing means of said first receiving means has the uppermost of said screens receive the materials of lighter specific gravity and heavier specific gravity adjacent its front end;

each of said screens is of smaller mesh in vertically descending order;

and said compressed air applying means includes means introducing compressed air above each of said screens, said introducing means introducing compressed air above the uppermost of said screen only forwardly of the introducing of compressed air above any of the other of said screens and introducing compressed air in rearwardly descending order above each of the other of said screens to the lowermost of said screens.

19. The apparatus according to claim 18 in which:

said water applying means applies a spray of water above each of said inclined screens of said third receiving means;

and said water applying means applies a spray of water above the uppermost of said screens rearwardly of said introducing means of said compressed air applying means introducing the compressed air above the uppermost of said screens.

20. The apparatus according to claim 17 in which:

said water applying means applies a spray of water above each of said inclined screens of said third receiving means;

and said water applying means applies a spray of water above the uppermost of said screens rearwardly of said introducing means of said compressed air applying means introducing the compressed air above the uppermost of said screens.

21. An apparatus for separating and cleaning a material of lighter specific gravity from a material of heavier specific gravity including:

first receiving means to receive materials of lighter specific gravity and heavier specific gravity;

first vibrating means to vibrate said first receiving means to separate particles of the materials from each other;

said first receiving means including sizing means to allow separated particles below a selected size to be removed from the materials;

fluid containing means including a medium therein to receive the remaining materials from said first receiving means initially in the top of the medium, the medium having a selected specific gravity to cause the material of lighter specific gravity to float to the top of the medium while the material of heavier specific gravity falls to the bottom of the medium;

a reservoir for the medium;

means to supply the medium to said fluid containing means from said reservoir to maintain the level of the medium to said fluid containing means at a selected level;

second receiving means to receive the material of lighter specific gravity and medium from the upper portion of said fluid containing means;

first removal means to remove a portion of the medium moving through said second receiving means with the material for return to said reservoir;

third receiving means to receive the material of lighter specific gravity and the remaining medium from said second receiving means;

second vibrating means to vibrate said third receiving means to separate the particles of material in said third receiving means from each other;

compressed air applying means to apply compressed air to spaced longitudinal portions of said third receiving means to remove medium from the particles of material in said third receiving means for return to said reservoir;

water applying means to apply a spray of water to spaced longitudinal portions of said third receiving means for application to the particles of material in said third receiving means to remove medium therefrom after the compressed air has been applied to at least the first of said spaced longitudinal portions of said third receiving means by said compressed air applying means;

first return means to return to said reservoir at least the medium removed from the particles of material in said third receiving means by said compressed air applying means at the first of said spaced longitudinal portions of said third receiving means;

second removal means to remove from the bottom of said fluid containing means the material of heavier specific gravity that sinks to the bottom of the medium in said fluid containing means;

means to apply compressed air to spaced longitudinal portions of said first receiving means to aid in separating the particles below the selected size from the materials in said first receiving means;

said third receiving means having a plurality of screens spaced vertically from each other, each of said screens being inclined from its front end rearwardly to the discharge end of said third receiving means;

said screens being substantially parallel to each other;

said third receiving means having the uppermost of said screens receive the material of lighter specific gravity and the remaining medium from said second receiving means adjacent its front end;

each of said screens being of smaller mesh in vertically descending order;

and said compressed air applying means including means introducing compressed air above each of said screens to remove medium from the particles of material, said introducing means introducing compressed air above the uppermost of said screens only forwardly of the introducing of compressed air above any of the other of said screens and introducing compressed air in rearwardly descending order above each of the other of said screens to the lowermost of said screens.

22. The apparatus according to claim 21 in which:

said sizing means of said first receiving means has a plurality of screens spaced vertically from each other, each of said screens is inclined from its front end rearwardly to the discharge end of said first receiving means;

said screens are substantially parallel to each other;

said sizing means of said first receiving means has the uppermost of said screens receive the materials of lighter specific gravity and heavier specific adjacent its front end;

each of said screens is of smaller mesh in vertically descending order;

and said compressed air applying means includes means introducing compressed air above each of said screens, said introducing means introducing compressed air above the uppermost of said screens only forwardly of the introducing of compressed air above any of the other of said screens and introducing compressed air in rearwardly descending order above each of the other of said screens to the lowermost of said screens.

23. The apparatus according to claim 22 in which:

said water applying means applies a spray of water above each of said inclined screens of said third receiving means;

and said water applying means applies a spray of water above the uppermost of said screens rearwardly of said introducing means of said compressed air applying means introducing the compressed air above the uppermost of said screens.

24. The apparatus according to claim 21 in which:

said water applying means applies a spray of water above each of said inclined screens of said third receiving means;

and said water applying means applies a spray of water above the uppermost of said screens rearwardly of said introducing means of said compressed air applying means introducing the compressed air above the uppermost of said screens.

25. A method for separating and cleaning a material of lighter specific gravity from a material of heavier specific gravity including:

receiving materials of lighter specific gravity and heavier specific gravity;

separating particles of the materials from each other by vibrating the received materials;

removing separated particles below a selected size from the received materials;

directing the remaining materials initially to the top of a bath of a medium having a selected specific gravity to cause the material of lighter specific gravity to float to the top of the medium while the material of heavier specific gravity falls to the bottom of the bath of the medium;

supplying medium to the bath from a reservoir;

directing the material of lighter specific gravity floating on top of the bath of the medium to receiving means;

collecting some of the medium during travel of the medium and the material of lighter specific gravity to the receiving means from the bath of the medium;

returning the collected medium to the reservoir;

vibrating the receiving means to vibrate the particles of material therein to separate the particles of material from each other;

applying compressed air at spaced longitudinal portions of the receiving means to the vibrating particles of material in the receiving means to remove medium therefrom;

applying a spray of water at spaced longitudinal portions of the receiving means to the vibrating particles of material to remove medium therefrom in the receiving means after the compressed air has been initially applied thereto;

collecting medium removed from the vibrating particles of material in the receiving means at at least the first spaced longitudinal portion of the receiving means to which the compressed air is applied;

returning the collected medium recovered from the vibrating particles of material in the receiving means to the reservoir;

removing from the bottom of the bath of the medium the material of heavier specific gravity that falls to the bottom of the bath of the medium;

applying compressed air to the materials of lighter specific gravity and heavier specific gravity at spaced longitudinal portions thereof during vibration thereof to aid in separating the particles beneath the selected size from the materials;

and applying compressed air to the bath of the medium above its bottom to create turbulence therein to aid in separating the material of lighter specific gravity from the material of heavier specific gravity.

26. The method according to claim 25 including:

directing the particles of material in the receiving means initially to the uppermost of a plurality of vibrating screens inclined from its front end rearwardly to the discharge end of the receiving means, substantially parallel to each other, and of smaller mesh in vertically descending order;

and applying the compressed air above each of the screens with the compressed air above the uppermost of the screens being introduced forwardly of the introduction of compressed air above any of the other screens and the compressed air being introduced rearwardly in descending order above each of the other screens to the lowermost of the screens.

27. The method according to claim 26 including:

separating the particles below the selected size from the materials by initially directing the materials to the uppermost of a plurality of vibrating screens inclined to the rear, substantially parallel to each other, and of smaller mesh in vertically descending order;

and applying the compressed air above each of the vibrating screens with the compressed air above the uppermost of the vibrating screens being introduced forwardly of the introduction of compressed air above any of the other vibrating screens and the compressed air being introduced rearwardly in descending order above each of the other vibrating screens to the lowermost of the vibrating screens.

28. The method according to claim 27 including:

applying a spray of water above each of the vibrating screens in the receiving means;

and applying the spray of water above the uppermost of the screens in the receiving means rearwardly of the initial introduction of compressed air.

29. The method according to claim 28 including applying the spray of water above any of the other of the vibrating screens in the receiving means forwardly of the introduction of compressed air above the same screen.

30. The method according to claim 26 including:

applying a spray of water above each of the vibrating screens in the receiving means;

and applying the spray of water above the uppermost of the screens in the receiving means rearwadly of the initial introduction of compressed air.

31. The method according to claim 30 including applying the spray of water above any of the other of the vibrating screens in the receiving means forwardly of the introduction of compressed air above the same screen.

* * * * *

UNITED STATES PATENT AND TRADEMARK OFFICE

CERTIFICATE OF CORRECTION

PATENT NO. : 4,360,423

DATED : November 23, 1982

INVENTOR(S) : Kidd S. Fugate

It is certified that error appears in the above—identified patent and that said Letters Patent is hereby corrected as shown below:

Column 1, line 20, "the" (second occurrence) should read -- to --.

Column 1, line 51, "requied" should read -- required --.

Column 1, line 54, "No.," should read -- No. --.

Column 2, line 39, delete "a".

Column 2, line 55, "o" should read -- of --.

Column 2, line 58, "a" should read -- the --.

Column 3, line 3, "supplying" should read -- applying --.

Column 3, line 16, "materials" should read -- material --.

Column 3, line 48, "14" should read -- 4 --.

Column 3, lines 57 and 58 should read -- tion and taken along line 6-6 of FIG. 1B;

FIG. 7 is a perspective view of a portion of the apparatus of the --.

Column 4, line 50, "beam" should read -- beams --.

Column 5, line 38, "o" should read -- of --.

UNITED STATES PATENT AND TRADEMARK OFFICE

CERTIFICATE OF CORRECTION

PATENT NO. : 4,360,423

DATED : November 23, 1982

INVENTOR(S) : Kidd S. Fugate

It is certified that error appears in the above—identified patent and that said Letters Patent is hereby corrected as shown below:

Column 6, line 3, " 1/2" " should read -- 3/4" --.

Column 7, line 17, "Th" should read -- The --.

Column 13, line 47 "water"should begin a new paragraph.

Column 13, lines 48 and 49 should read -- apply a spray of water to spaced longitudinal portions of said third receiving --.

Column 14, line 5, delete "said".

Column 14, lines 6 to 9 should read -- said third receiving means has a plurality of screens spaced vertically from each other, each of said screens is inclined from its front end rearwardly to the discharge end of said third receiving means; --.

Column 16, line 55, the "period (.)" should be a -- semi-colon (;) --.

UNITED STATES PATENT AND TRADEMARK OFFICE

CERTIFICATE OF CORRECTION

PATENT NO. : 4,360,423

DATED : November 23, 1982

INVENTOR(S) : Kidd S. Fugate

It is certified that error appears in the above-identified patent and that said Letters Patent is hereby corrected as shown below:

Column 17, line 47, "screen" should read -- screens --.

Column 20, line 33, "recovered" should read -- removed --.

Column 22, line 10, "rearwadly" should read -- rearwardly --.

Signed and Sealed this

*Twelfth* Day of *April 1983*

[SEAL]

*Attest:*

GERALD J. MOSSINGHOFF

*Attesting Officer*

*Commissioner of Patents and Trademarks*